US005921047A

United States Patent [19]

Walker

[11] Patent Number: 5,921,047

[45] Date of Patent: Jul. 13, 1999

[54] BUILDING STRUCTURE HAVING PREFABRICATED INTERFITTING STRUCTURAL PARTS

[76] Inventor: Marshall P. Walker, 1060 East Ave., Madison, Ga. 30650

[21] Appl. No.: 08/822,790

[22] Filed: Mar. 24, 1997

[51] Int. Cl.[6] ..... E04B 1/12; E04B 1/61

[52] U.S. Cl. ..... 52/585.1; 52/57; 52/91.1; 52/93.2; 52/282.2; 52/284; 52/286; 52/592.1; 52/783.17; 52/783.19; 52/745.05; 52/747.1

[58] Field of Search ..... 52/91.1, 93.2, 52/57, 282.2, 284, 286, 585.1, 592.1, 783.17, 783.19, 747.1, 745.05

[56] References Cited

U.S. PATENT DOCUMENTS

| | | | |
|---|---|---|---|
| 1,696,104 | 12/1928 | Seward et al. . | |
| 1,820,869 | 8/1931 | Evers . | |
| 1,889,138 | 11/1932 | Wolfson . | |
| 2,047,062 | 7/1936 | Eheler . | |
| 2,467,581 | 4/1949 | Connell . | |
| 2,575,758 | 11/1951 | Herd | 52/783.17 X |
| 2,617,160 | 11/1952 | Bodnar . | |
| 3,236,014 | 2/1966 | Edgar | 52/286 X |
| 3,747,290 | 7/1973 | Barrell et al. | 52/91.1 |
| 4,114,338 | 9/1978 | Beck . | |
| 4,872,297 | 10/1989 | Hetzel et al. | 52/91.1 |
| 5,425,207 | 6/1995 | Shayman | 52/783.19 X |

*Primary Examiner*—Christopher Kent
*Attorney, Agent, or Firm*—Thomas, Kayden, Horstemeyer & Risley

[57] ABSTRACT

A preferred embodiment of a building structure (10) having prefabricated, interfitting structural parts comprising wall panels (12) forming an enclosure (11) and roof panels (14) forming a peaked roof structure (13) above the enclosure (11). The wall panels (12) are preferably joined by duplicate spaced wall panel connector elements. The roof panels (14) preferably forming the peaked roof structure (13) are joined to abutting roof panels (14) at their side edges by duplicate spaced roof panel connector elements. These connector elements, in one embodiment, can embody duplicate spaced protrusions and recesses of appropriate size and shape. The adjacent upper ends of the roof panels (14) are joined together by a roof ridge connector (81). The roof ridge connector (81) is appropriately angled to match the slope of the peaked roof structure (13). The peaked roof structure (13) is supported above the enclosure by the top edges of the wall panels (12). A roof connecting strip (76) would preferably be attached to the bottom surface of the peaked roof structure (13) near the unconnected ends of the roof panels (14) and interfit with the connector elements along the upper horizontal edges of the wall panels (12).

37 Claims, 9 Drawing Sheets

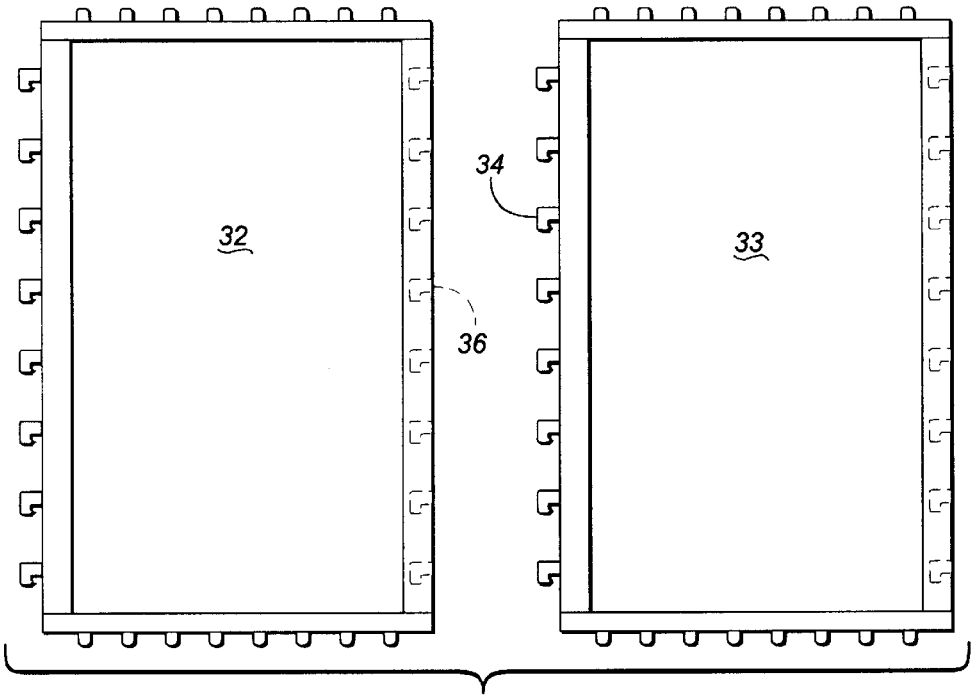
FIG. 7
FIG. 8A
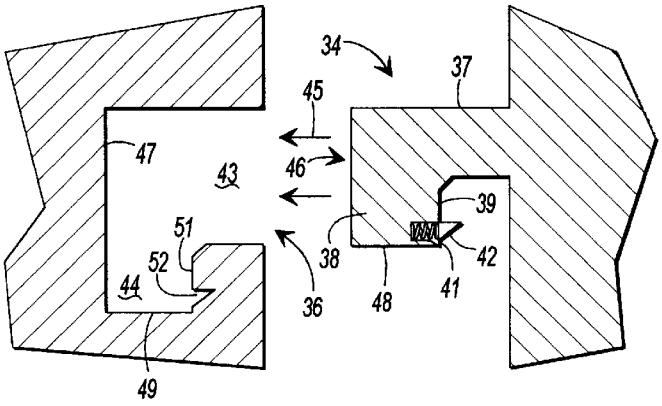
FIG. 8B
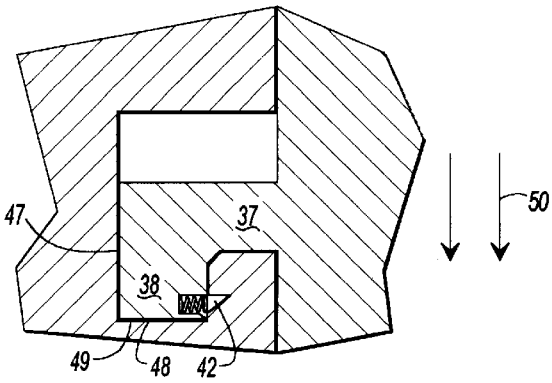

BUILDING STRUCTURE HAVING PREFABRICATED INTERFITTING STRUCTURAL PARTS

FIELD OF THE INVENTION

The present invention relates generally to a building structure and, more particularly, to a building structure having prefabricated interfitting structural parts.

BACKGROUND OF THE INVENTION

Most personal dwelling structures are made from wood, aluminum, bricks, concrete blocks, and similar sturdy materials and the structures include electrical wiring and plumbing and other high quality and expensive features. However, many of these traditional materials and features are inappropriate for non-traditional construction applications where simplicity and speed of erection is essential and when electrical wiring and plumbing may not be included in the structure.

One situation where common methods and materials would be particularly inappropriate is in remote regions of third world countries. Other examples include emergency/natural disaster situations or military operations. In all of these applications, it is required that the materials used to construct a building be light weight such that they are easily transported. Other requirements include low cost, ease and speed of assembly, and minimization of the tools required for assembly. Unfortunately, all of the materials commonly used for dwelling structures today are inadequate for these and other similar applications.

Initially, the materials commonly used for contemporary construction are relatively heavy. For example, one vehicle generally cannot carry enough wood, bricks, concrete blocks, or even aluminum to construct a single building structure. Therefore, constructing a building out of such materials requires the materials be transported by machinery or additional persons. However, if the building structure is to be constructed in a remote region, use of machinery is often not possible. On the other hand, it may not be practical to employ several persons to transport materials into the remote region for only one, small structure.

Even if there is appropriate transportation for the materials, transportation costs are likely to increase the cost of construction. These transportation costs are in addition to the high cost for the materials themselves.

Most of the materials commonly in commercial and home construction use in the United States today are difficult for persons of little or no skill to assemble into a building. Indeed, to assemble a structure out of wood, aluminum, concrete, or brick, the builder must possess a substantial body of knowledge. For example, the builder must be careful to keep the structure square, as well as the walls vertical to the floor. The builder must also be conscious of providing proper structural support for the walls and the roof. Obviously, for a person to construct a building out of bricks, wood, aluminum, or other common materials, some basic construction knowledge, instructions, or teaching is required.

Even if one has the knowledge to construct a structure out of common construction materials, the builder still needs tools. For example, when building with wood, the builder must at least possess a hammer, a saw, and other basic tools. To construct a building out of brick or concrete blocks, a block cutter and a trowel would be minimally necessary. Other materials commonly used for construction require similar tools and the basic knowledge to use them properly.

Another reason that common construction materials are inadequate for some special applications is the various connectors required for assembly. Most of the materials commonly used for construction require connectors such as nails, screws, adhesives, or mortar. These connectors also require special tools and knowledge to use. These connectors also contribute to the expense of the building and the time required for construction.

One of the chief shortcomings of building materials in common use is the time required to assemble a structure using these materials. A building structure of only moderate size often requires several days, if not weeks, to complete. For military or emergency applications, this is a prohibitively long time period.

Thus, there exists a need for a lightweight, easily-assembled, inexpensive building structure and method for assembly. Such a building structure would overcome the many problems of the prior art building materials and it is to the provision of such a method and apparatus that the present invention is primarily directed.

SUMMARY OF THE INVENTION

Briefly described, the present invention comprises a building structure having prefabricated, interfitting structural parts. The building structure includes light-weight wall panels placed on their bottom edges and standing approximately vertical. Several wall panels are placed edge-to-edge such that they form an enclosure. On the edges of each wall panel unit are duplicate spaced wall panel connector elements. These wall panel connector elements allow two adjacent wall panels to cooperate with one another such that the various wall panels are joined together securely.

The duplicate spaced wall panel connector elements can comprise a group of protrusions, corresponding in size, shape and placement to a group of recesses on an adjacent wall panel. The protrusions and recesses would be sized and shaped such that they interconnect with one another. In such a configuration, the protrusions would be along one side and the top edge of the wall panels. Correspondingly sized and spaced recesses would be along the bottom edge and other side edge of the wall panels. However, this particular configuration of recesses and protrusions is not the only wall panel connector elements possible.

The protrusions and recesses can also form a detent connector mechanism for releasably connecting to an adjacent wall panel. Thus, once two wall panels are connected, there is resistance to separating the two panels.

The building structure of the present invention also comprises light-weight roof panels generally of a construction similar to the wall panels and which are placed edge-to-edge so as to form a peaked roof structure above the enclosure formed by the wall panels. The side edges of each roof panel can include spaced interfitting roof panel connector elements. These roof panel connector elements allow two adjacent roof panels to cooperate with one another such that the various roof panels are securely joined to one another.

The roof panels of the present invention are supported near one end by the top edges of the wall panels. A roof connecting strip preferably is attached to the bottom surface of the roof panels. The roof connecting strips cooperate with the wall panels along the top edges of the wall panels and form a support surface for the roof panels an angle corresponding to the desired slope of the roof structure.

In the preferred embodiment, the opposite ends of the roof panels rise to an apex and are connected by a roof ridge connector means. The roof ridge connector means is appropriately angled to match the slope of the roof panels. The roof ridge connector means can also be constructed to interconnect as the wall panel connector elements described above.

In another embodiment, a single roof panel could span from one side of the structure to the other. In this way, the roof would be flat, or if one wall was higher than the other, sloped. Regardless, the roof connecting strips would still form a support surface for the roof panels at an angle corresponding to the desired slope, if any, of the roof structure.

The wall panels of the building structure can be attached to an appropriate flooring unit. Such attachment occurs if a locking strip is placed along or in the flooring unit such that the bottom edges of the wall panels could cooperate with this locking strip. The cooperation occurs through appropriately sized and spaced recesses and protrusions along the connector strip and lower edges of the wall panels.

To decrease the overall weight of the wall and roof panels, these panels may be constructed of a corrugated fibercore material, such as cardboard or honeycomb. This fibercore material can be treated so as to be water-resistant. When the wall and roof panels are formed in this manner, the wall and roof panel connector elements preferably are formed on plastic end caps. Such end caps are equal in width to the thickness of the fibercore panels and equal in length to an edge of these same fibercore panels. As such, the end caps are inserted on the edges of the wall and roof panels with the connector elements facing away from the panel to which the cap is attached. To prevent longitudinal shifting of the end cap, a series of tines may protrude from an inner face of the end cap so as to engage an edge of the fibercore material.

Therefore, an object of the present invention is to provide a sturdy, light weight, weather resistant building structure and method for assembling the structure.

Another object of the novel building structure described herein is to reduce the need for machinery to transport the materials out of which the building structure will be constructed.

Another object of the present invention is to provide an inexpensive modular building structure and method of constructing the building for minimizing labor costs required for erecting the building.

Another object is to provide a building structure that can be easily assembled by unskilled labor without detailed instructions with little chance of assembly error.

Another object of the present invention is to provide a building structure which can be assembled with a minimal number of tools and completely without the use of power tools.

Other objects, features and advantages of the present invention will be apparent to those skilled in the art. A more thorough understanding of the invention will be gained through a review of the detailed description set forth below, when taken in conjunction with the accompanying drawings, which are briefly described as follows.

BRIEF DESCRIPTION OF THE DRAWINGS

FIG. 7 is a side view of two wall panels with spring-loaded spherical component connector elements operating as a detent mechanism.

FIG. 8A is a schematic side view of a spring loaded spherical component connector element before mating with a corresponding connector element.

FIG. 8B is a schematic side view of a spring loaded spherical component connector element mated with a corresponding connector element.

DETAILED DESCRIPTION OF THE PREFERRED EMBODIMENT

Figure 1:
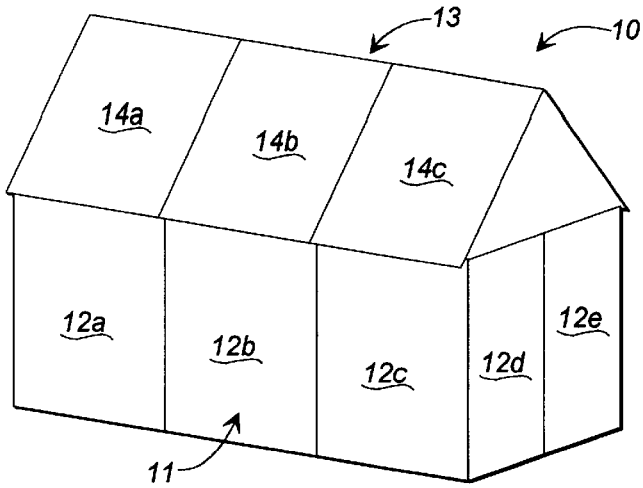
FIG. 1 is a perspective view of a building structure having prefabricated interfitting structural parts, having a peaked roof.

Referring now to the drawings wherein like reference numerals designate corresponding parts throughout the several views, a preferred embodiment of a prefabricated modular building structure 10 is depicted in FIG. 1. The building structure 10 preferably comprises an enclosure 11 formed by a plurality of wall panels 12*a*, 12*b*, 12*c*, 12*d*, 12*e* and a peaked roof structure 13 formed by a plurality of roof panels 14*a*, 14*b*, 14*c*.

Figure 2A:
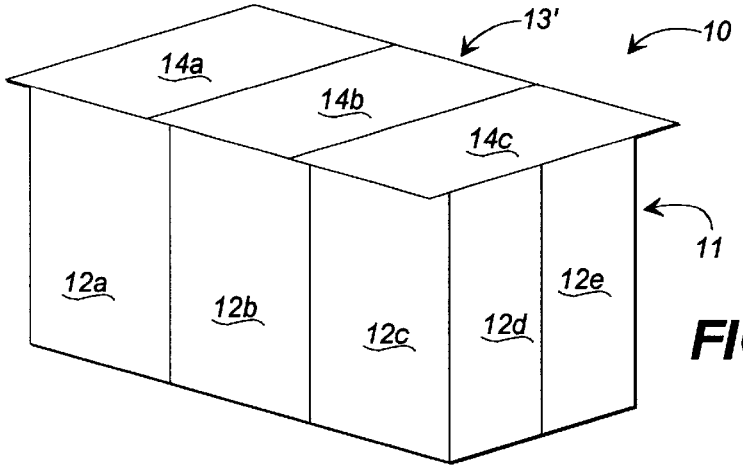
FIG. 2A. is a perspective view of a building structure having prefabricated interfitting structural parts, wherein the roof structure is sloped.
Figure 2B:
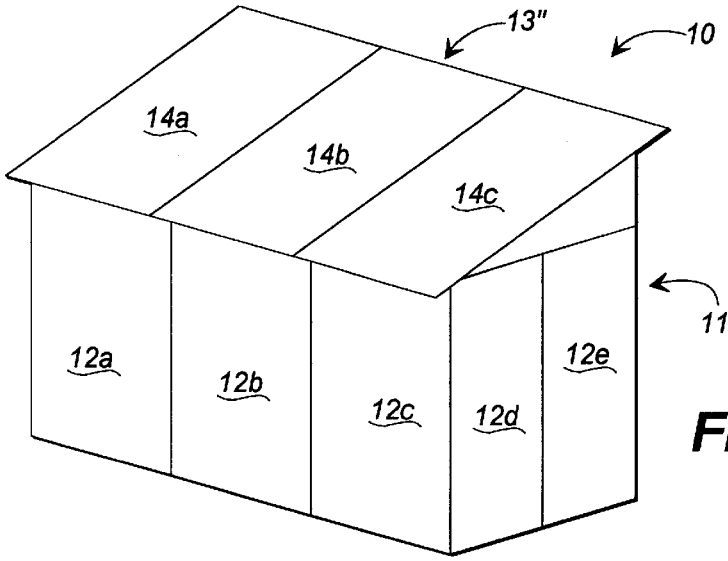
FIG. 2B is a perspective view of a building structure having prefabricated interfitting structural parts, wherein the roof is flat.

Another possible embodiment of a prefabricated modular building structure 10 is depicted in FIG. 2A. This building structure 10 comprises an enclosure 11 formed by a plurality of wall panels 12*a*, 12*b*, 12*c*, 12*d*, 12*e* and a sloped roof structure 13' formed by a plurality of roof panels 14*a*, 14*b*, 14*c*. As an alternative, the prefabricated modular building structure 10 can be constructed as depicted in FIG. 2B. This alternative embodiment could comprise an enclosure 11 formed by a plurality of wall panels 12*a*, 12*b*, 12*c*, 12*d*, 12*e* and a flat roof structure 13" formed by a plurality of roof panels 14*a*, 14*b*, and 14*c*.

Figure 3:
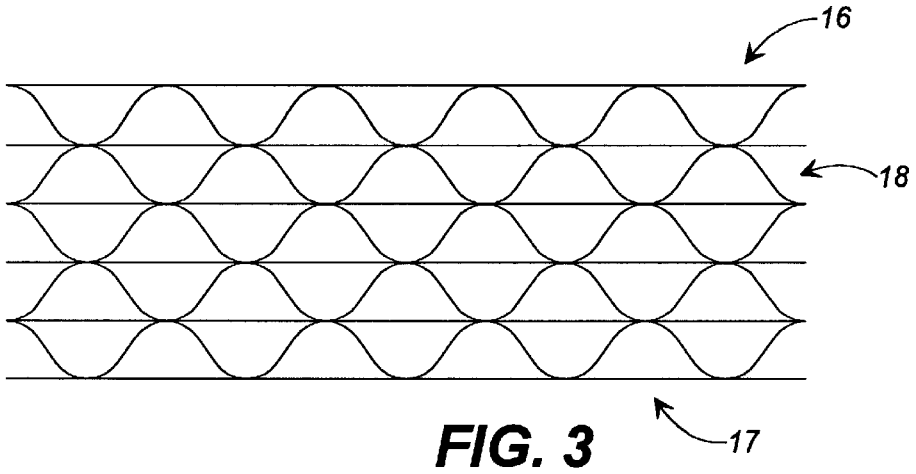
FIG. 3 is a cross-sectional view of a corrugated fibercore panel.

In all embodiments, the wall panels 12*a*–12*e* and the roof panels 14*a*–14*c* are preferably constructed of a light-weight fibercore or cardboard material. FIG. 3 depicts a top view of the preferred construction of a fibercore panel 16 which can be used to make the wall panels 12*a*–12*e* and the roof panels 14*a*–14*c* of FIGS. 1–2B. Typical of fibercore panels, the facings 17 and the flutes 18 are constructed of a corrugated medium, as depicted in FIG. 3. Preferably, the materials making up the facings 17 and the flutes 18 are treated for moisture protection and/or fire retardancy. While the present invention is not limited to a fibercore material, such a material permits very light weight wall panels 12*a*–12*e* and roof panels 14*a*–14*c* while maintaining relatively high strength and rigidity.

Figure 4:
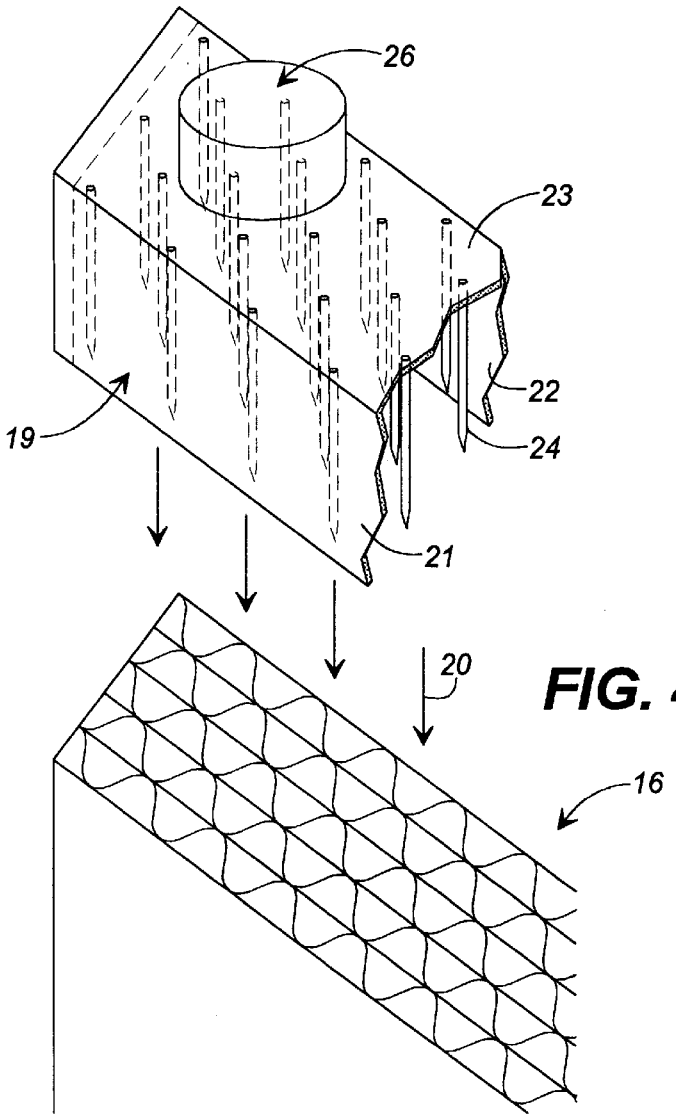
FIG. 4 is a cut-away perspective view of an end cap with connector elements and a corrugated fibercore panel.

As depicted in FIG. 4, once a piece of fibercore 16 is cut to the appropriate size for a wall panel 12*a*–12*e* or a roof panel 14*a*–14*c*, a cap 19 should preferably be placed over the edges of the fibercore panel 16. Although not limited to such a construction, the cap 19 can be made of a light-weight molded plastic. Although not limited to such a design, the preferred embodiment of a cap 19 is an elongated, trough-like structure the same length as the fibercore edge sought to be covered. One of the primary purposes for the cap 19 is to protect the fibercore panel 16 from moisture. Preventing moisture from entering between the flutes 18 will enable the fibercore panel 16 to withstand the environment for a greater period of time.

The end cap 19 is constructed with parallel, opposing sides 21, 22 and a top surface 23 joining the two sides. The top surface 23 is designed such that its width is approximately the same as the thickness of the fibercore panel 16. In that way, the cap 19 can comfortably, but snugly, slide over the edge of the fibercore panel 16 as depicted by the arrows 20 in FIG. 4.

To make the cap 19 fit more securely onto the fibercore panel 16, the preferred embodiment depicted in FIG. 4 shows cap 19 with tines 24 protruding from the interior of the cap's top surface 23. In that way, when the cap 19 is slidably mounted onto the fibercore panel 16, the tines 24 will be driven into the flutes 18 of the fibercore panel 16, thereby more securely attaching the cap 19 onto the fibercore panel 16 and preventing longitudinal shifting of the end cap 19.

The caps 19, which are slidably mounted onto the wall panels 12 comprise wall panel connector elements on the outer side of their top surface 23. Similarly, the caps 19 which are slidably mounted onto the roof panels 14 comprise roof panel connector elements on the outer side of their top surface 23. These connector elements should be designed so that two adjacent fibercore panels 16 can be joined to one-another by means of the connector elements.

Figure 5:
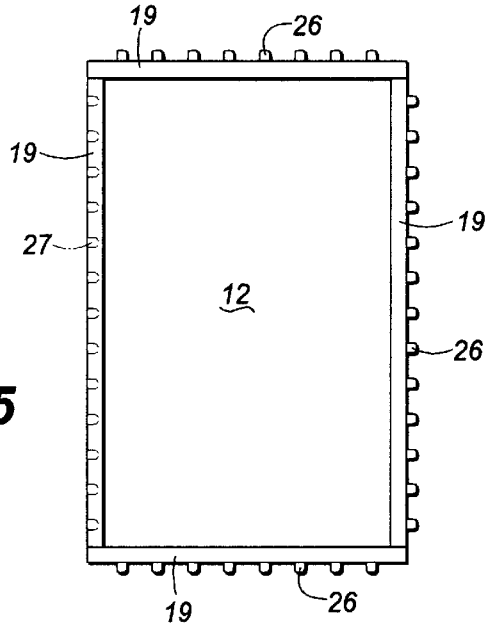
FIG. 5 is a front view of a wall panel with duplicate equally spaced connector elements.

Although not limited to such a configuration, the preferred wall panel connector elements are depicted in FIG. 5. These wall panel connector elements comprise a system where the caps 19 on one side edge, the top edge, and the bottom edge, of a wall panel 12 have a series of locking protrusions 26 and the caps 19 on the opposing side edge have a series of locking recesses 27. In this way, as depicted in FIG. 1, the locking protrusions 26 of one wall panel 12*a* can be inserted into the locking recesses 27 of an adjacent wall panel 12*b*. An adhesive can be easily applied to the locking protrusions, insuring a tight, weatherproof seal and a "permanent" joining of the panels.

While such wall panel connector elements are simple to use, the system of locking protrusions 26 and locking recesses 27 will securely attach adjacent wall panels (such as 12*a* and 12*b* in FIG. 1) such that a force normal to the face of a wall panel 12 will not easily displace one wall panel 12*a* from an adjacent wall panel 12*b*, as depicted in FIG. 1. Furthermore, use of such wall panel connector elements requires no tools to assemble the building structure 10 of FIG. 1, and prevents most builder errors.

Figure 6:
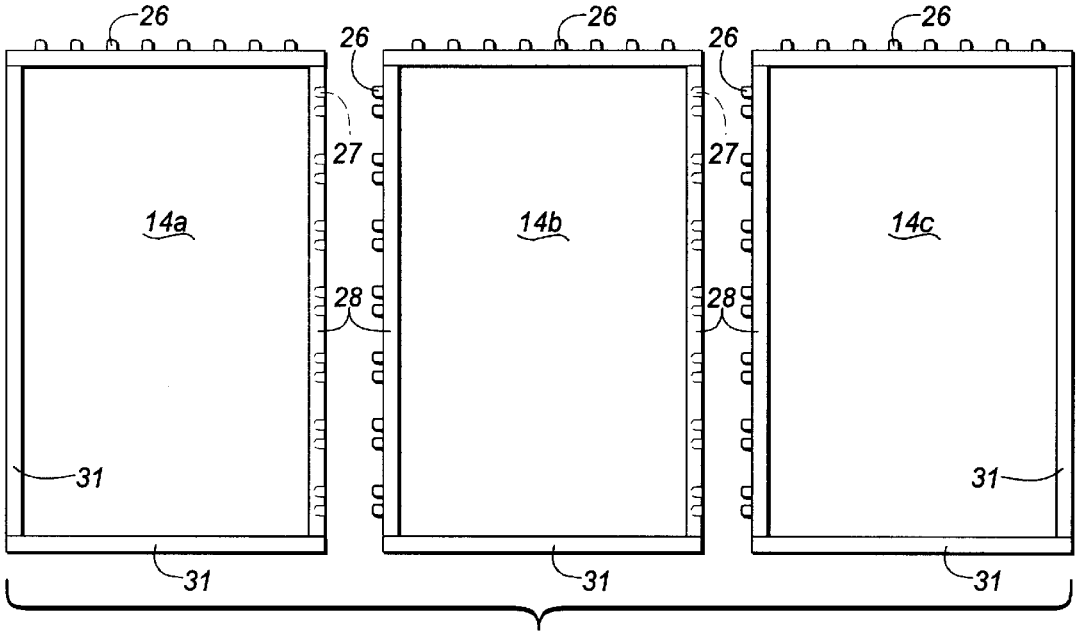
FIG. 6 is a front view of three roof panels with duplicate unequally spaced connector elements.

As depicted in FIG. 5, the locking protrusions 26 and locking recesses 27 of a wall panel can be evenly spaced along the caps 19. However, in the preferred embodiment depicted in FIG. 6, end caps 28 housing roof panel connector elements should be attached on at least one side edge of each roof panel 14*a*–14*c*. These end caps 28 are constructed differently from the end caps 19 used on wall panels 12. As depicted in FIG. 6, the locking protrusions 26 and locking recesses 27 along the roof end caps 28 are preferably spaced with alternating small and large distances between a given locking protrusion 26 and locking recess 27 pair. As such, it would be impossible for a builder to incorrectly use a roof panel 14*a*–14*c* as a wall panel 12 (see FIG. 5), or alternatively, to use a wall panel 12 (see FIG. 5) for roof panel 14*a*–14*c*.

Additionally, as depicted in FIG. 6, only the interior roof panels 14*b* require connector elements along both side edges. Roof panels 14*a*, 14*c* on the ends of the roof structure 13 can have end caps 31, which do not have roof panel connector elements. Likewise, the bottom edge of all roof panels 14*a*–14*c* can be covered by an end cap 31 with no roof panel connector elements. However, it would not affect the operation of the present invention if all edges of all roof panels 14*a*–14*c* have end caps 19 or 28 with suitable connector elements.

Furthermore, the present invention is not intended to be limited to the presence of only three roof panels 14*a*–14*c* per side of the peaked roof structure 13, as depicted in FIGS. 6 and 1. Any number of roof panels 14 could be used to form the peaked roof structure 13.

The connector elements depicted in FIGS. 4–6 are not the only possible connector elements usable with the present invention. For example, FIG. 7 depicts two wall panels 32, 33 which have a series of modified locking protrusions 34 and recesses 36 on the end caps 19 covering their two vertical side edges. As shown with more particularity in FIG. 8A, a modified locking protrusion 34 is formed into an "ell" shape with a horizontal component 37 and a vertical component 38. The horizontal component 37 of the modified locking protrusion 34 is preferably the same length as the connector element locking protrusion 26 depicted in FIGS. 4–6. Likewise, the width of the vertical component 38 of the modified locking protrusion 34 is preferably the same width as the locking protrusion 26 of the connector elements depicted in FIGS. 5–6.

Along the interior wall 39 of the vertical component 38, there is a gap 41 through which a spherical element 42 protrudes. The spherical element 42 preferably has a larger diameter than the interior wall gap 41 such that the spherical element 42 cannot pass out of the vertical component 38 of the modified locking protrusion 34. This spherical element 42 is preferably spring-loaded such that pressure upon the spherical element 42 will cause said element 42 to become flush with the interior wall 39.

The modified ell-shaped locking recess 36 comprises a horizontal neck area 43 and a chamber area 44. The neck area 43 should be the same width as the length of the vertical component 38 of the modified locking protrusion 34. The depth of the chamber area 44 of the modified locking recess 36 should be of the same dimension as the width of the vertical component interior wall 39.

In this way, the modified locking protrusion 34 can be inserted horizontally into the modified locking recess 36 as depicted by the arrows 45 in FIG. 8A. The modified locking protrusion 34 should be moved horizontally until the exterior wall 46 of the modified locking protrusion 34 rests against the back wall 47 of the modified locking recess 36. At this point, the modified locking protrusion 34 can be moved vertically downward (as depicted by arrows 50 in FIG. 8B) such that the lower surface 48 of the vertical component 38 rests against the base wall 49 of the modified locking recess 36 as depicted in FIG. 8B. During the vertical sliding motion, the spherical component 42 will be initially depressed by the receiving wall 51 of the modified locking recess 36 such that the inner wall 39 of the vertical component 38 is approximately flat. When the lower surface 48 of the vertical component 38 of the modified locking protrusion 34 rests against the base wall 49 of the modified locking recess 36, the spherical component 42 is allowed to protrude through the inner wall gap 41 and into an appropriately sized receiver 52 along the receiving wall 51 of the modified locking recess 36.

These alternative connector elements join two adjacent wall panels 12 or roof panels 14 much more securely than the connector elements described above. For this reason, the connector elements depicted in FIGS. 7, 8A, and 8B may be preferred for some applications.

Figure 9:
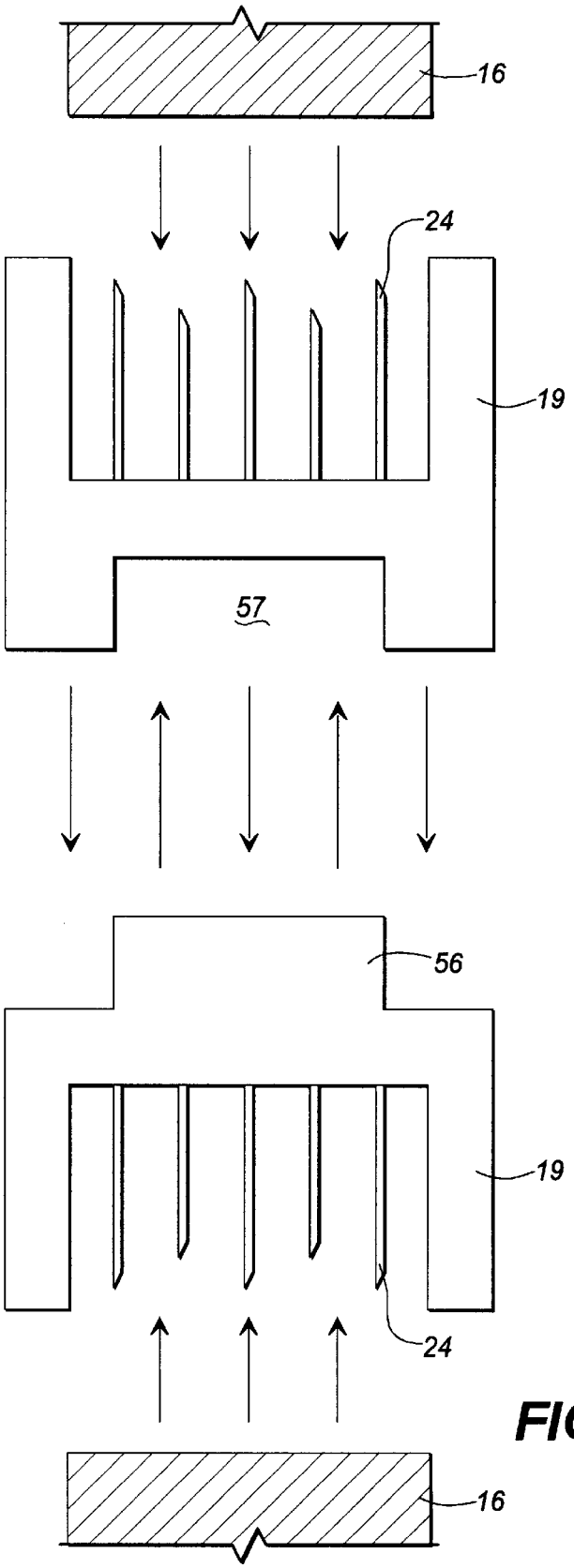
FIG. 9 is a top view of a first and a second wall panel and their corresponding end caps with an elongated protrusion and an elongated recess respectively as connecting elements.

FIG. 9 depicts yet another possible embodiment for an end cap 19 connector element. In this embodiment, the cap 19 has a single, elongated protrusion 56 extending the length of the cap 19. A corresponding cap 19 has a long trough or elongated recess 57. In this way, the elongated protrusion 56 can be slidably inserted into the elongated recess 57, thus connecting adjacent wall panels 12 or roof panels 14.

Many other appropriate connecting means will be evident to those with skill in the art. The present invention is intended to incorporate such appropriate connecting means.

Figure 10:
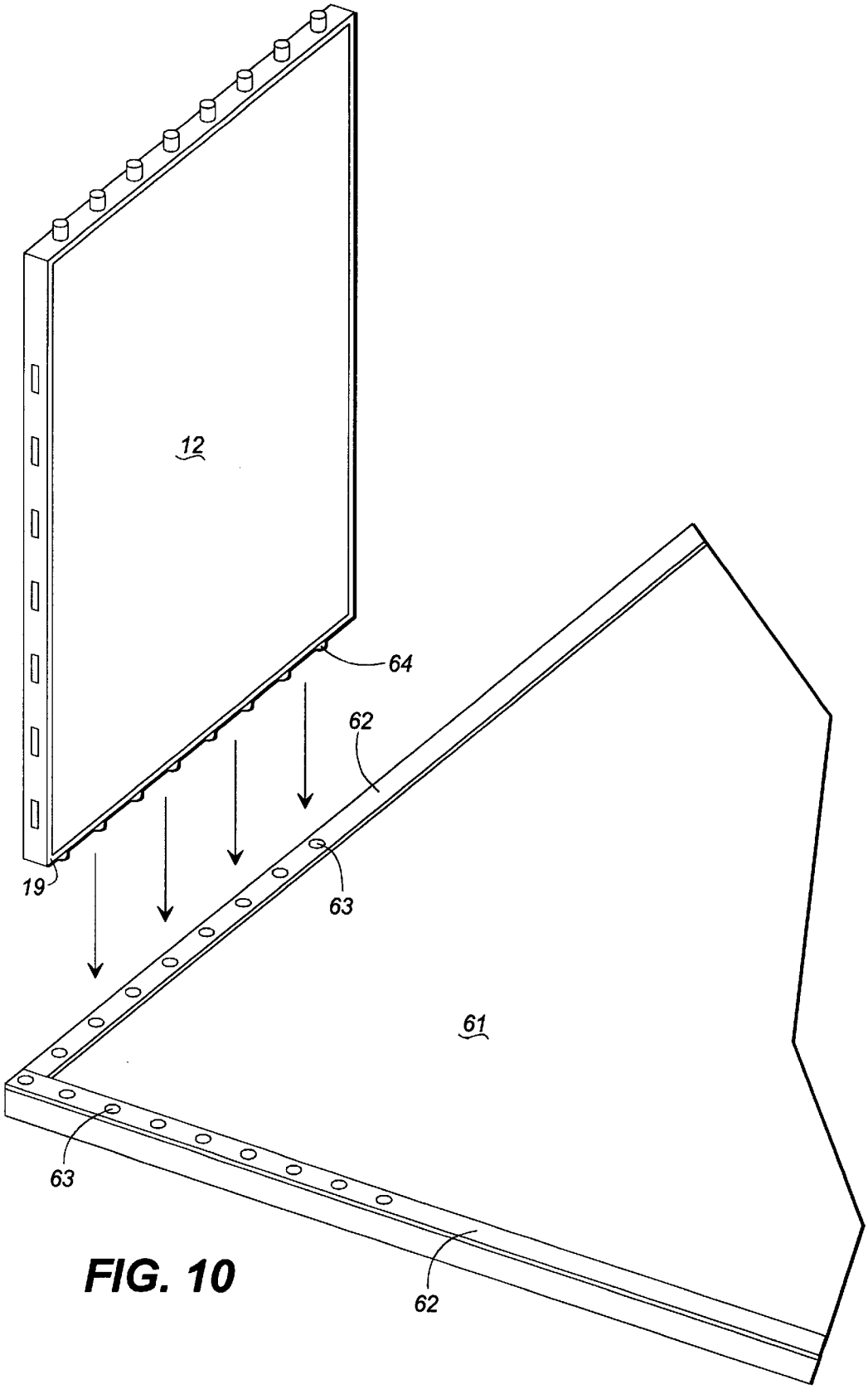
FIG. 10 is a perspective view of a wall panel and a flooring system with locking strip.

As depicted in FIG. 10, a wall panel 12 can be secured at its bottom edge to a floor system 61. A floor system 61 is preferably constructed of a rigid material, such as concrete, wood or fibercore panels with a laminated sheet of plywood, masonite or other suitable materials. The floor system 61 will also preferably contain a locking strip 62 tracing the positions the wall panels 12 making up the enclosure. The locking strip 62 should preferably comprise recesses 63 corresponding to protrusions 64 on the cap 19 along the bottom edge of the wall panel 12. Therefore, a wall panel 12 can be securely fastened to the flooring system 61 by means of these interconnecting recesses 63 and protrusions 64.

Figure 11A:
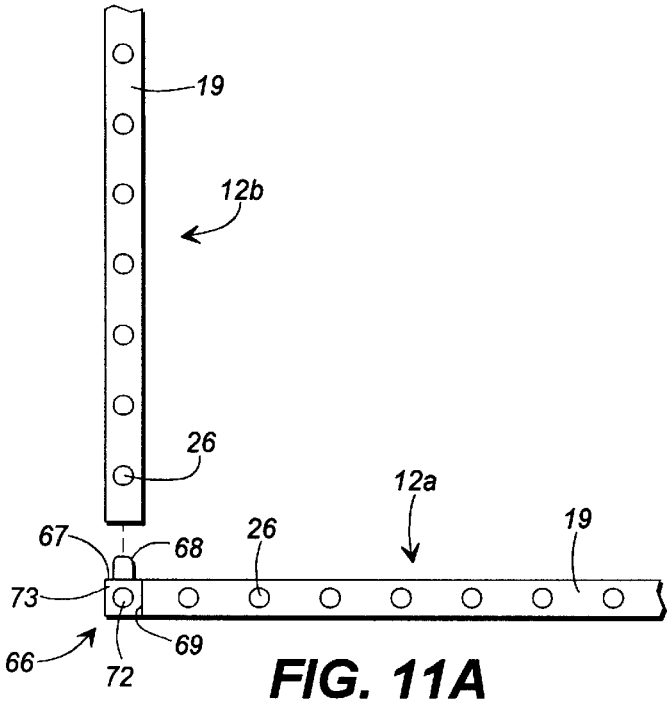
FIG. 11A is a top view of a first wall panel connected to a corner connecting strip and a second wall panel disposed ninety degrees from the first wall panel and for connecting with the corner connecting strip.
Figure 11B:
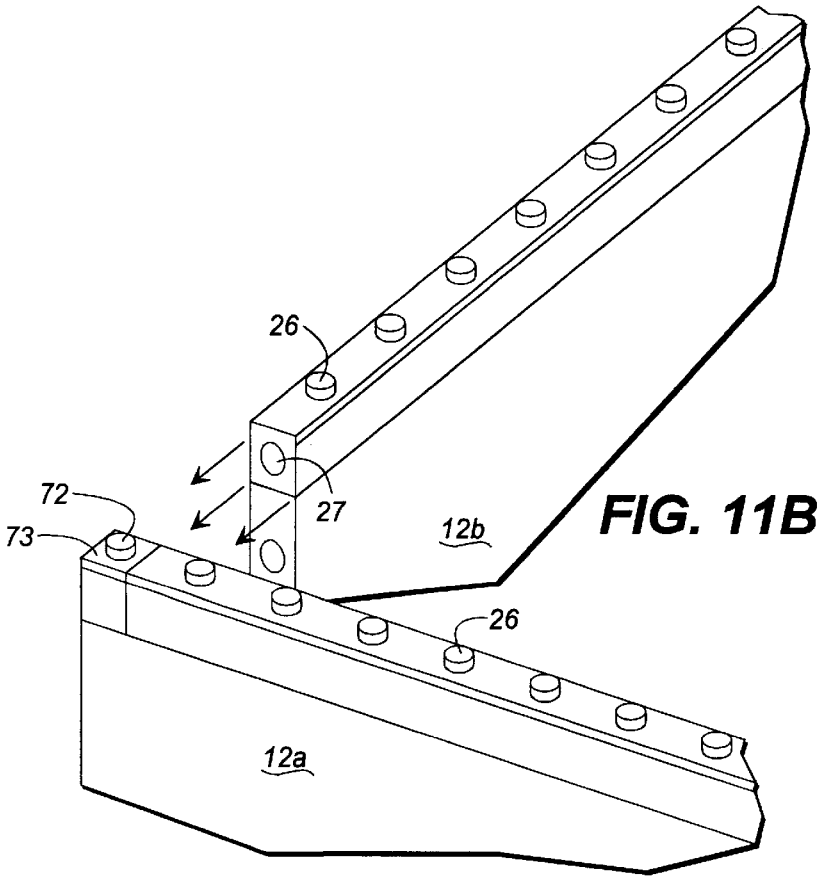
FIG. 11B is a perspective view of a first wall panel connected to a corner connecting strip and a second wall panel disposed ninety degrees from the first wall panel and for connecting with the corner connecting strip.

In the construction of the enclosure 13 of the building structure 10 depicted in FIG. 1, a corner connecting strip 66 should preferably be employed, as depicted in FIGS. 11A–11B. As depicted in FIG. 11A, a corner connecting strip 66 comprises a square, elongated member the same length as the height of a first wall panel 12*a* and a second wall panel 12*b*. A first side 67 of the corner connecting strip 66 comprises a series of appropriately spaced connecting elements. In the embodiment pictured, the connecting elements are duplicate spaced protrusions 68 and recesses (not pictured). However, any appropriate connecting elements could be used on the corner connecting strip 66. The protrusions 68 of FIG. 11A should be the same size and shape as the protrusions 26 of the caps 19 on the wall panels 12*a*–12*b*. A second side 69, adjacent to the first side 67 of the elongated connecting strip 66 comprises appropriately sized and spaced recesses (not shown). As with the protrusions 68 of the first side 67, these recesses should be the same size and shape as the recesses 27 of the caps 19 on the wall panel 12*b* in FIG. 11B. As such, this corner connecting strip 66 will permit two wall panels 12*a*, 12*b* to connect at a 90° angle.

Additionally, the corner connecting strip 66 can have a single protrusion (not pictured) on its bottom surface and a single protrusion 72 on its top surface 73. These protrusions on the ends of the corner connecting strip 66 permit it to attach to the flooring system depicted in FIG. 10 and the roof structure.

Figure 12:
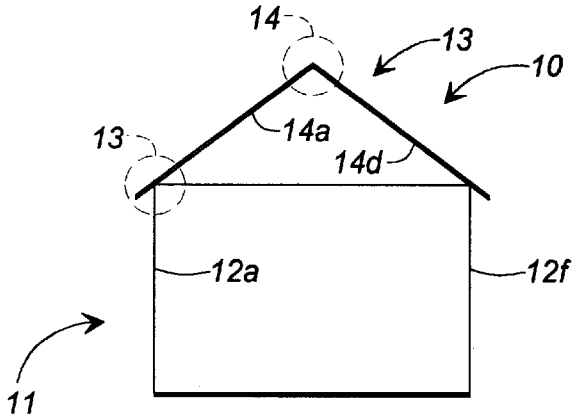
FIG. 12 is a schematic side view of a peaked roof structure connected to an enclosure formed by a plurality of connected wall panels.
Figure 13:
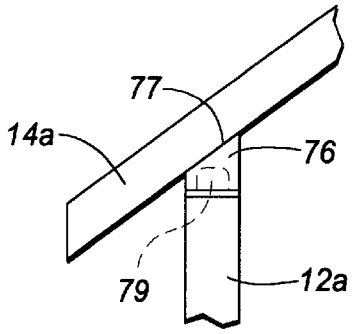
FIG. 13 is a cut-away side view of a roof connecting strip connecting the top edge of a wall panel to the under side of a roof panel.

As mentioned above, the preferred embodiment of the present invention also includes roof panels (14*a*, 14*b*, 14*c* in FIG. 1) forming a roof structure (13 in FIG. 1, 13' in FIG. 2A, or 13" in FIG. 2B). FIG. 12 depicts the preferred embodiment of a modular building structure 10 with a peaked roof structure 13. As depicted in FIG. 12, roof panels 14*a*, 14*d* should be positioned in a sloped attitude with relation to the wall panels 12*a*, 12*f* in order to form a peaked roof structure 13. The lower portions of the roof panels 14*a*, 14*d* are attached to the top edge of the wall panels 12*a*, 12*f*. Opposing roof panels 14*a*, 14*d* are attached to each-other at upper horizontal surface.

FIG. 13 more particularly shows the preferred embodiment for the attaching means which secures a given roof panel 14*a* to a wall panel 12*a*. This attaching means preferably comprises a roof connecting strip 76 attached to the under surface of a roof panel 14*a*. The roof connecting strip 76 has an upper surface 77 which is angled to correspond to the desired slope of the roof panel 14*a*. The bottom surface 78 of the roof connecting strip 76 is not angled and contains connector elements 79 corresponding to the type used on the cap 19 for the top edge of the wall panel 12*a*. In the preferred embodiment, the roof connecting strip 76 comprises duplicate spaced locking recesses 27 such that the roof connecting strip 76 corresponds with the wall panel connector elements of the cap 19 along the top edge of a wall panel 12*a*.

The roof connecting strip 76 is preferably attached securely to the roof panel 14*a* by some common attachment means. The roof connecting strip 76 may be connected by an adhesive, screws, nails or any other appropriate attaching means. Once securely fastened to the roof panel 14*a*, the roof connecting strip 76 can then cooperate with the connecting means of the cap 19 along the top edge of the wall panel 12*a*.

Figure 16A:
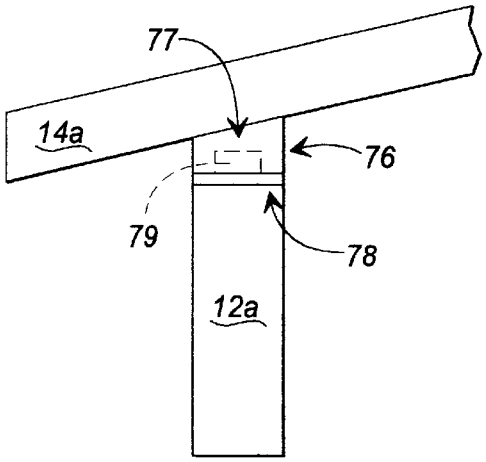
FIG. 16A is a cut-away side view of a roof connecting strip connecting the top edge of a wall panel to the under side of a roof panel, where the roof is sloped.
Figure 16B:
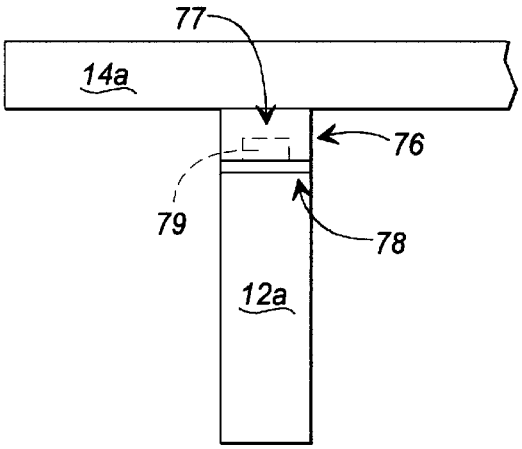
FIG. 16B is a cut-away side view of a roof connecting strip connecting the top edge of a wall panel to the under side of a roof panel, where the roof is flat.

The attachment means depicted in FIG. 13 can be modified so as to connect a sloped roof 13', as depicted in FIG. 16A, or a flat roof 13", as depicted in FIG. 16B, to the enclosure structure. For either of these embodiments, the upper surface 77 of the roof connecting strip 76 should be angled to correspond to the desired slope of the roof panel 14*a*. Thus, for a flat roof 13", the upper surface 77 would not be angled, as depicted in FIG. 16B. On the other hand, for a sloped roof 13', the upper surface 77 would be angled, but to a lesser extent than depicted in FIG. 13 (as shown in FIG. 16A).

Figure 14:
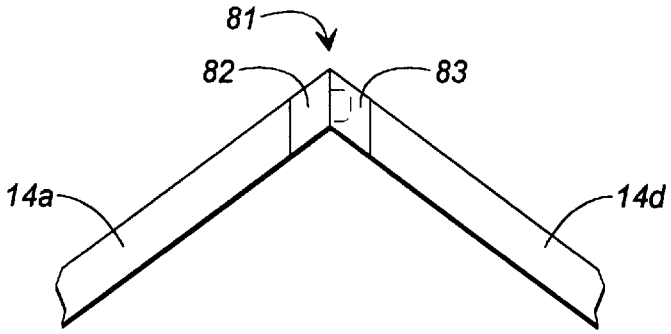
FIG. 14 is a cut-away side view of a roof ridge connector means joining two opposing roof panels at their upper horizontal edges.

FIG. 14 depicts a roof ridge connector means 81 for use with the preferred peaked roof structure 13. This roof ridge connector means 81 preferably comprises a first angled end cap 82 with duplicate spaced locking protrusions 83 and a second angled end cap 84 with duplicate spaced locking recesses 86. In this way, the locking protrusions 83 can be inserted into the corresponding locking recesses 86. Furthermore, the roof ridge connector means 81 can be angled such that it corresponds with the angle of the top surface 77 of the roof connecting strip 76. The angle of the roof ridge connector means 81 can be changed by altering the angles of the first angled end cap 82 and the second angled end cap 84 accordingly.

Figure 15A:
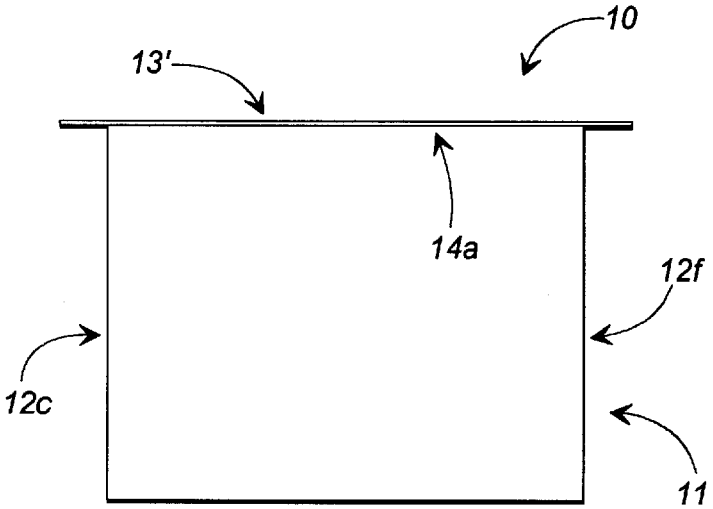
FIG. 15A is a schematic side view of a sloped roof structure connected to an enclosure formed by a plurality of connected wall panels.
Figure 15B:
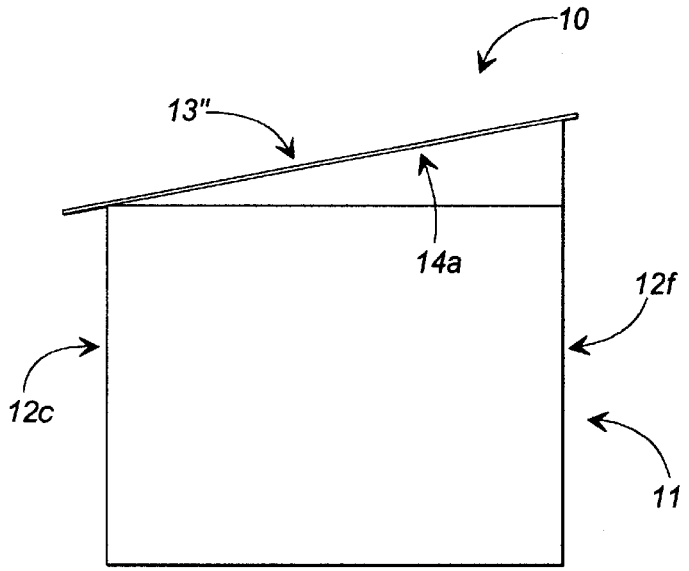
FIG. 15B is a schematic side view of a flat roof structure connected to an enclosure formed by a plurality of connected wall panels.

Obviously, the connector means 81 depicted in FIG. 14 is unnecessary for either of the embodiments of the roof structure 13', 13" depicted in FIGS. 15A or 15B. The roof structure 13', 13" would not be comprised of opposing roof panels to be connected by angled end cap 82 and 83. Instead, a single set of roof panels 14*a*, 14*b*, 14*c* would span from one series of wall panels to an opposing series of wall panels. A pair of roof connecting strips 76 would secure the roof panels 14*a*, 14*b*, 14*c* to the wall panels.

It would be apparent to one skilled in the art that many variations and modifications may be made to the preferred embodiment as described above without substantially departing from the principles of the present invention. All such variations and modifications are intended to be included herein and are within the scope of the present invention, as set forth in the following claims.

I claim:

1. A building structure having prefabricated interfitting structural parts, comprising:

wall panels placed in upstanding attitude with opposed vertical side edges and opposed horizontal top and bottom edges, said wall panels being arranged in side edge to side edge abutment with one another to form an enclosure;

one of said side edges and the top edge of each of said wall panels including along their lengths a plurality of duplicate shaped equally spaced locking protrusions, and the other of said side edges and the bottom edge of said wall panels including along their lengths a plurality of duplicate shaped equally spaced locking recesses sized and shaped to interconnect with said locking protrusions;

roof panels placed in a sloped attitude and forming a peaked roof structure on and supported by the top edges of said wall panels, said roof panels each having opposed side edges and opposed horizontal top and bottom edges, said roof panels arranged in side-edge to side-edge abutment with one another to form a roof above the wall enclosure;

a roof connecting strip attached to an under surface of said roof panels and having a plurality of said second wall panel connector elements which interconnect with said first connector elements on said top edges of said wall panels;

one of the side edges of at least one of said roof panels including along its length a first plurality of duplicate spaced roof panel connector elements, and the adjacent side edge of the next adjacent roof panel including along its length a second plurality of duplicate spaced roof panel connector elements which interconnect with said first roof panel connector elements; and a roof ridge connector means connecting together the adjacent upper ends of said roof panels.

2. The building structure of claim 1, further comprising a locking strip for placement along a foundation connected to said second plurality of duplicate spaced wall panel connector elements.

3. The building structure of claim 1, wherein said roof ridge connector means comprises a locking strip extending along and locked to the upper edges of said roof panels.

4. The building structure of claim 1, wherein said first and second wall panel connector elements are of different configuration than said roof panel connector elements so that the edges of said roof panels cannot be inadvertently interconnected with the edges of said wall panels.

5. The building structure of claim 1, wherein said wall panels and said roof panels are constructed of a corrugated fibercore material.

6. The building structure of claim 5, wherein said corrugated fibercore material is treated so as to be water resistant.

7. The building structure of claim 1, further comprising a corner connecting strip for permitting a first wall panel to interfit with a second wall panel at a ninety degree angle.

8. A building structure having prefabricated interfitting structural parts, comprising:

wall panels placed in upstanding attitude with opposed vertical side edges and opposed horizontal top and bottom edges, said wall panels being arranged in side edge to side edge abutment with one another to form an enclosure;

one of said side edges and the top edge of each of said wall panels including along their lengths a first plurality of duplicate spaced wall panel connector elements, and the other of said side edges and the bottom edge of said wall panels including along their lengths a second plurality of duplicate spaced wall panel connector elements which interconnect with said first wall panel connector elements, wherein said wall panel connector elements are formed upon an end cap for covering the edges of said wall panels;

roof panels forming a roof structure on and supported by the top edges of said wall panels, said roof panels each having opposed side edges and opposed horizontal edges, said roof panels arranged in side-edge to side-edge abutment with one another to form a roof above the wall enclosure;

a plurality of roof connecting strips attached to an under surface of said roof panels and having a plurality of said second wall panel connector elements which interconnect with said first connector elements on said top edges of said wall panels; and one of the side edges of at least one of said roof panels including along its length a first plurality of duplicate spaced roof panel connector elements, and the adjacent side edge of the next adjacent roof panel including along its length a second plurality of duplicate spaced roof panel connector elements which interconnect with said first roof panel connector elements, wherein said roof panel connector elements are formed upon an end cap for covering the edges of said roof panels.

9. The building structure of claim 8, wherein said wall panels and said roof panels are constructed of a corrugated fibercore material.

10. The building structure of claim 9, wherein said end cap comprises:

(a) a top surface of approximately equal width to an edge of said corrugated fibercore material and equal in length to a side of said corrugated fibercore material, wherein said panel connector elements are formed along an outer face of said top surface;

(b) a series of tines protruding from an inner face of said top surface for engaging said fibercore material to prevent said end cap from shifting longitudinally along said edge of said corrugated fibercore material;

(c) a first side equal in length to said top surface and connected along an edge to a first edge of said top surface; and (d) a second side equal in length to said top surface and connected along an edge to a second edge of said top surface.

11. A method for assembling a building structure having prefabricated interfitting structural parts, which comprises:

(a) providing a plurality of wall panels;

(b) inserting an end cap on each side of said wall panels, wherein said end cap forms wall panel connector elements;

(c) forming an enclosure by connecting adjacent wall panels along their vertical edges by means of said wall panel connector elements;

(d) providing a plurality of roof panels;

(e) inserting an end cap on at least one side edge of said roof panels, wherein said end cap forms roof connector elements;

(f) inserting a roof ridge connector element on an upper horizontal edge of said roof panels;

(g) forming a peaked roof structure by connecting adjacent roof panels along their non-horizontal edges by means of said roof connector elements, and connecting adjacent upper horizontal edges of said roof panels; and (h) connecting said peaked roof structure to said enclosure by means of a roof connecting strip.

12. The method of claim 11, further comprising the steps of:

(a) providing a flooring system; and (b) connecting said wall panels to said flooring system by means of a locking strip.

13. The method of claim 11, wherein said wall panels and said roof panels comprise a corrugated fibercore material.

14. The method of claim 13, wherein said end caps comprise a plastic material.

15. The method of claim 11, wherein said wall panel connector elements comprise a detent mechanism.

16. The method of claim 11, wherein a first wall connector element comprises a single elongated locking protrusion, and a second wall connector element comprises a single elongated locking recess sized and shaped to interconnect with said single elongated locking protrusion.

17. The method of claim 11, further comprising the steps of:

(a) providing a corner connecting strip, (b) joining a first wall panel to a second wall panel along adjacent vertical sides at a ninety degree angle using said corner connecting strip.

18. A method for assembling a building structure having prefabricated interfitting structural parts, which comprises:

providing a plurality of wall panels;

inserting an end cap on each side of said wall panels, wherein said end cap forms wall panel connector elements;

forming an enclosure by connecting adjacent wall panels along their vertical edges by means of said wall panel connector elements;

providing a plurality of roof panels;

inserting an end cap on at least one side edge of said roof panels, wherein said end cap forms roof panel connector elements;

forming a roof structure by connecting adjacent roof panels along their side edges by means of said roof panel connector elements;

attaching a roof connector strip to an under surface of said roof structure; and connecting said roof structure to said enclosure by cooperation between said roof connecting strip and a top edge of said wall panels.

19. An improved dwelling unit having:

(a) a plurality of fibercore wall panels arranged in edge-to-edge upright relationship, (b) a flooring system connected to and supporting said fibercore wall panels, and (c) a plurality of angularly disposed fibercore roof panels attached to a top edge of said fibercore wall panels;

wherein the improvement comprises:

(a) a roof connecting strip having a sloped upper surface attached to an underside of said angularly disposed fibercore roof panels, and a lower surface forming a first connector element for resting on and interfitting with said wall panels, and (b) an end cap having a lower surface mounted to said top edge of said fibercore wall panels, and an upper surface forming a second connector element for mating with said first connector element.

20. An improved dwelling unit having:

(a) a plurality of fibercore wall panels arranged in side-edge to side-edge upright relationship, (b) a flooring system connected to and supporting said fibercore wall panels, and (c) a plurality of angularly disposed fibercore roof panels attached to a top edge of said fibercore wall panels and converging upwardly together to form a roof ridge above said fibercore wall panels;

wherein the improvement comprises a roof ridge connector means having:

(a) a first angled end cap mounted to a top edge of a first roof panel and forming a first connector element, and (b) a second angled end cap mounted to a top edge of a second roof panel and forming a second connector element which mates with said first connector element.

21. A building structure having prefabricated interfitting structural parts, comprising:

wall panels placed in upstanding attitude with opposed vertical side edges and opposed horizontal top and bottom edges, said wall panels being arranged in side edge to side edge abutment with one another to form an enclosure;

one of said side edges and the top edge of each of said wall panels including along their lengths a first plurality of duplicate spaced wall panel connector elements, and the other of said side edges and the bottom edge of said wall panels including along their lengths a second plurality of duplicate spaced wall panel connector elements which interconnect with said first wall panel connector elements, wherein said first and second duplicate spaced wall panel connector elements comprise a detent mechanism;

roof panels placed in a sloped attitude and forming a peaked roof structure on and supported by the top edges of said wall panels, said roof panels each having opposed side edges and opposed horizontal top and bottom edges, said roof panels arranged in side-edge to side-edge abutment with one another to form a roof above the wall enclosure;

a roof connecting strip attached to an under surface of said roof panels and having a plurality of said second wall panel connector elements which interconnect with said first connector elements on said top edges of said wall panels;

one of the side edges of at least one of said roof panels including along its length a first plurality of duplicate spaced roof panel connector elements, and the adjacent side edge of the next adjacent roof panel including along its length a second plurality of duplicate spaced roof panel connector elements which interconnect with said first roof panel connector elements; and a roof ridge connector means connecting together the adjacent upper ends of said roof panels.

22. The building structure of claim 21, further comprising a locking strip for placement along a foundation connected to said second plurality of duplicate spaced wall panel connector elements.

23. The building structure of claim 21, wherein said roof ridge connector means comprises a locking strip extending along and locked to the upper edges of said roof panels.

24. The building structure of claim 21, wherein said first and second wall panel connector elements are of different configuration than said roof panel connector elements so that the edges of said roof panels cannot be inadvertently interconnected with the edges of said wall panels.

25. The building structure of claim 21, further comprising a corner connecting strip for permitting a first wall panel to interfit with a second wall panel at a ninety degree angle.

26. The building structure of claim 21, wherein said wall panels and said roof panels are constructed of a corrugated fibercore material.

27. The building structure of claim 26, wherein said corrugated fibercore material is treated so as to be water resistant.

28. A building structure having prefabricated interfitting structural parts, comprising:

wall panels placed in upstanding attitude with opposed vertical side edges and opposed horizontal top and bottom edges, said wall panels being arranged in side edge to side edge abutment with one another to form an enclosure;

one of said side edges and the top edge of each of said wall panels including along their lengths a single elongated locking protrusion, and the other of said side edges and the bottom edge of said wall panels including along their lengths a single elongated locking recess sized and shaped to interconnect with said single elongated locking protrusion;

roof panels placed in a sloped attitude and forming a peaked roof structure on and supported by the top edges of said wall panels, said roof panels each having opposed side edges and opposed horizontal top and bottom edges, said roof panels arranged in side-edge to side-edge abutment with one another to form a roof above the wall enclosure;

a roof connecting strip attached to an under surface of said roof panels and having a plurality of said second wall panel connector elements which interconnect with said first connector elements on said top edges of said wall panels;

one of the side edges of at least one of said roof panels including along its length a first plurality of duplicate spaced roof panel connector elements, and the adjacent side edge of the next adjacent roof panel including along its length a second plurality of duplicate spaced roof panel connector elements which interconnect with said first roof panel connector elements; and a roof ridge connector means connecting together the adjacent upper ends of said roof panels.

29. The building structure of claim 28, further comprising a locking strip for placement along a foundation connected to said single elongated locking recess.

30. The building structure of claim 28, wherein said roof ridge connector means comprises a locking strip extending along and locked to the upper edges of said roof panels.

31. The building structure of claim 28, wherein said first and second wall panel connector elements are of different configuration than said roof panel connector elements so that the edges of said roof panels cannot be inadvertently interconnected with the edges of said wall panels.

32. The building structure of claim 28, further comprising a corner connecting strip for permitting a first wall panel to interfit with a second wall panel at a ninety degree angle.

33. The building structure of claim 28, wherein said wall panels and said roof panels are constructed of a corrugated fibercore material.

34. The building structure of claim 33, wherein said corrugated fibercore material is treated so as to be water resistant.

35. A building structure having prefabricated interfitting structural parts, comprising:

wall panels placed in upstanding attitude with opposed vertical side edges and opposed horizontal top and bottom edges, said wall panels being arranged in side edge to side edge abutment with one another to form an enclosure;

one of said side edges and the top edge of each of said wall panels including along their lengths a first plurality of duplicate spaced wall panel connector elements, and the other of said side edges and the bottom edge of said wall panels including along their lengths a second plurality of duplicate spaced wall panel connector elements which interconnect with said first wall panel connector elements, wherein said wall panel connector elements are formed upon an end cap for covering the edges of said wall panels;

roof panels placed in a sloped attitude and forming a peaked roof structure on and supported by the top edges of said wall panels, said roof panels each having opposed side edges and opposed horizontal top and bottom edges, said roof panels arranged in side-edge to side-edge abutment with one another to form a roof above the wall enclosure;

a roof connecting strip attached to an under surface of said roof panels and having a plurality of said second wall panel connector elements which interconnect with said first connector elements on said top edges of said wall panels;

one of the side edges of at least one of said roof panels including along its length a first plurality of duplicate spaced roof panel connector elements, and the adjacent side edge of the next adjacent roof panel including along its length a second plurality of duplicate spaced roof panel connector elements which interconnect with said first roof panel connector elements, wherein said roof panel connector elements are formed upon an end cap for covering the edges of said roof panels; and a roof ridge connector means connecting together the adjacent upper ends of said roof panels.

36. The building structure of claim 35, wherein said wall panels and said roof panels are constructed of a corrugated fibercore material.

37. The building structure of claim 36, wherein said end cap comprises:

(a) a top surface of approximately equal width to an edge of said corrugated fibercore material and equal in length to a side of said corrugated fibercore material, wherein said panel connector elements are formed along an outer face of said top surface;

(b) a series of tines protruding from an inner face of said top surface for engaging said fibercore material to prevent said end cap from shifting longitudinally along said edge of said corrugated fibercore material;

(c) a first side equal in length to said top surface and connected along an edge to a first edge of said top surface; and (d) a second side equal in length to said top surface and connected along an edge to a second edge of said top surface.

* * * * *